United States Patent [19]

Grünwald et al.

[11] Patent Number: 4,572,146

[45] Date of Patent: Feb. 25, 1986

[54] DEVICE FOR INJECTING FUEL IN COMBUSTION CHAMBERS

[75] Inventors: Werner Grünwald, Gerlingen; Ernst Imhof, Munchingen; Iwan Komaroff, Regensburg; Rolf Mayer, Winnenden-Schelmenholz; Gunther Schmid, Stuttgart, all of Fed. Rep. of Germany

[73] Assignee: Robert Bosch GmbH, Stuttgart, Fed. Rep. of Germany

[21] Appl. No.: 695,034

[22] Filed: Jan. 25, 1985

[30] Foreign Application Priority Data

Apr. 14, 1984 [DE] Fed. Rep. of Germany ..... 3414201

[51] Int. Cl.[4] ..... F02B 9/08

[52] U.S. Cl. ..... 123/549; 123/145 A; 123/298; 123/557

[58] Field of Search ..... 123/549, 557, 145 A, 123/298

[56] References Cited

U.S. PATENT DOCUMENTS

| | | | |
|---|---|---|---|
| 1,100,293 | 6/1914 | Forde | 123/549 |
| 1,230,909 | 6/1917 | Lepper | 123/145 A |
| 1,379,060 | 5/1921 | Sumner | 123/145 A |
| 1,464,253 | 8/1923 | Wales | 123/549 |
| 1,472,233 | 10/1923 | Taylor | 123/549 |
| 1,497,390 | 6/1924 | Straus | 123/549 |
| 1,525,624 | 2/1925 | Suter | 123/145 A |
| 1,641,421 | 9/1927 | French | 123/145 A |
| 1,780,499 | 11/1930 | Novelli | 123/145 A |
| 2,855,908 | 10/1958 | Pflaum | 123/286 |
| 3,868,939 | 3/1975 | Friese | 123/549 |
| 3,915,137 | 10/1975 | Evans | 123/549 |
| 4,308,845 | 1/1982 | Sarto | 123/549 |
| 4,325,341 | 4/1982 | Yamauchi | 123/549 |
| 4,469,058 | 9/1984 | Linder | 123/145 A |

FOREIGN PATENT DOCUMENTS

| | | | |
|---|---|---|---|
| 53-139014 | 12/1978 | Japan | 123/549 |

*Primary Examiner*—Ronald B. Cox
*Attorney, Agent, or Firm*—Edwin E. Greigg

[57] ABSTRACT

A device for injecting fuel in combustion chambers, especially for self-igniting internal combustion engines, is proposed, in which a fuel injection nozzle, by aspirating air through an air guide device in the manner of a jet pump, generates a fuel spray that is surrounded by an air envelope. This air-enveloped fuel spray is directed through a heating element, the heat generation of which is distributed in such a manner over its length that a desired heating profile along the heating element is produced. The type of heating profile depends not only on the properties of the material making up the heating resistor but also on its structural makeup and its electrical bonding. A highly suitable material for the heating resistor is molybdenum silicide ($MoSi_2$).

13 Claims, 5 Drawing Figures

DEVICE FOR INJECTING FUEL IN COMBUSTION CHAMBERS

BACKGROUND OF THE INVENTION

The invention is based on a device for injecting fuel in combustion chambers as defined hereinafter. In a known device of this type (German Pat. No. 834 467), the heating coil of a glow plug surrounds the fuel spray emerging from an injection nozzle. Additionally, fresh air is blown out of the cylinder asymmetrically and laterally at right angles to the injected spray at one point in the injection conduit. In this apparatus, although portions of the fuel which had previously been heated are transported into the cylinder in an accelerated manner, the disadvantage nevertheless exists that parts of the fuel strike the heating coil of the glow plug and partially carbonize there, and further that fuel particles are blown against the wall of the injection conduit by the fresh air stream emerging from the side. Optimal combustion does not take place, which has an unfavorable effect on both efficiency and exhaust gas composition.

OBJECT AND SUMMARY OF THE INVENTION

The apparatus according to the invention has the advantage over the prior art that the heating element meets divergent requirements for both a short heating-up time and good long-term glow action. In an advantageous embodiment of the invention, the temperature of the heating element is higher in its middle area than in its outer regions. The middle, substantially hotter region makes short heating times possible, and because of the greater temperature difference with respect to the fuel spray traveling past it in the air envelope, the transfer of heat is improved.

A further substantial advantage of the device according to the invention is that the heating element heats up the fuel spray without touching it. the intensive infrared radiation particularly heats the fuel droplets of the air-fuel swirl, while the air is heated by convection wherever it flows past the heating coil. The fuel-air mixture is thus effectively pre-heated to attain ready flammability, yet the heating element does not come into contact with fuel.

The heating element is mechanically retained in the regions where the heating element is at a lower temperature. A substantially more reliable retention is possible at this lower temperature.

In a further development of the inventive concept, this desired temperature distribution is attained by providing that the heating element is embodied as a resistance heating element through which electric current flows, its heating resistance being higher in its middle region than in the outer regions. Thus a desired heating element temperature profile can be established very accurately. A resistance heating element must be electrically bonded such that it is very reliable in operation; this is readily attainable in the areas that are at a lower temperature, without having to lose the advantages of good heat transfer and short heating-up time.

An advantageous structural feature is that the resistance heating element is embodied as a cylindrical glow body which can be electrically bonded at both end faces. It may be favorable for the diameter of the cylindrical glow body to increase toward the end faces. In this embodiment of the invention, the glow body may be the carrier of the heating resistor and can assure the necessary mechanical strength. Furthermore, the greater diameter of the end faces enables a larger electrically effective cross section and particularly reliable bonding. The heating resistor is favorably supplied with electric current by attaching bonding disks to the end faces of the glow body using a suitable solder.

In a further advantageous embodiment of the invention, the glow body is embodied, at least in its middle region, as a helical heating resistor the resistor coil of which has a smaller cross section in its middle area than in its outer regions. With this provision, it is simple to define the temperature profile over the cross section of the resistor coil, for the electrical resistance per unit of length of the helical heating resistor dictates the electrical heating output produced.

Especially for ceramic resistor materials, easily replicable characteristics can be attained by cutting the helical heating resistor out of a tube of resistor material by milling, with the pitch of the milled coil being variable in order to vary the cross section of the resistor coil. In an advantageous embodiment, the helical heating resistor is made of molybdenum silicide material ($MoSi_2$). This feature of the invention makes it possible for the critical temperature zones of the glow body to be associated with the zones at the end faces of the glow body, which are relatively unstressed thermally, for with the material $MoSi_2$ the phenomenon of low-temperature oxydation can occur during long-term operation at approximately 500°-600° C., while suitable temperatures at the end faces of the glow body make it possible for bonding disks to be soldered to the glow body in a melt-proof manner.

If the helical heating resistor is made of the $MoSi_2$ material and milled out of a tube of this material, then in order to improve its mechanical strength it may be advantageous for supporting means to be provided, in the form of struts, between at least some windings of the helical heating resistor. These supporting means may comprise axially attached layers of electrically insulating ceramic paste, thereby making it possible to combine the advantages of the desired glow body temperature profile with those of the resistance material $MoSi_2$. One advantage of $MoSi_2$ is that it has a positive temperature coefficient (PTC) effect (an increase in resistance when there is an increase in temperature), producing very short heating-up times and causing the electrical power consumption to adapt automatically to varying load states without requiring an external control device. Since $MoSi_2$ has very good strength at high temperatures, and since it is readily obtainable, it is well suited as a replacement for platinum heating elements. A glow body which is particularly stable mechanically is characterized in that an electrically insulating cylinder which encompasses the helical heating resistor is provided as the supporting means.

A further advantageous embodiment of the inventive concept provides that the cylindrical glow body has holes, in the manner of a perforation, on its jacket face and that the density of the holes is greater in its middle regions than in its outer regions. In order to generate the desired temperature profile it may even be sufficient for the perforation to be present solely in the middle regions of the cylindrical glow body. A structure equivalent in importance to the perforation may be attained by designing the cylindrical glow body at least partially as a cellular structure, the effective electrical resistance being higher in the middle region, because of the cellular structure, than in the outer regions.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
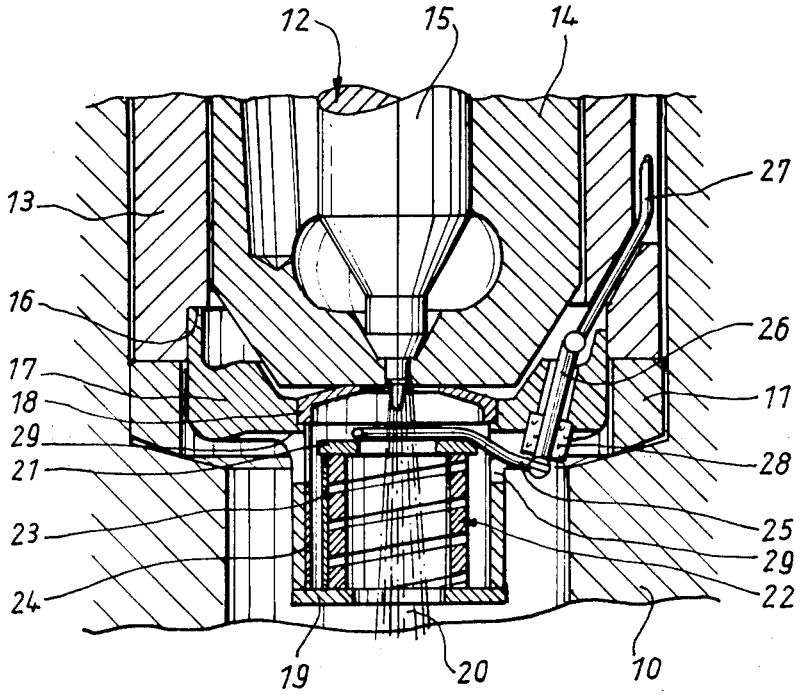
FIG. 1 shows an injection nozzle having an exemplary embodiment of the device according to the invention.

In the exemplary embodiment shown in FIG. 1, a fuel injection nozzle 12 is inserted in an engine block 10 by means of a nozzle clamping nut 13 via a spacer ring 11. The fuel injection nozzle 12 has a valve needle 15 operating in a nozzle body 14. With the nozzle clamping nut 13, the nozzle body 14 is clamped to a nozzle holder, not shown in FIG. 1. A housing 17 of a heating device is secured in an undercut groove 16 on the end of the nozzle clamping nut 13 adjacent to the combustion chamber. The bottom of the nozzle body 14 is braced against the housing 17 of the heating device via a support plate 18. The housing 17 is closed off on the end toward the combustion chamber by a cover 19. The support plate 18 and the cover 19 are embodied as concentric elements, so that the fuel spray 20 can reach the combustion chamber (not shown in further detail in the drawings) without hindrance. A cylindrical glow body 22, the mechanical strength of which is improved by one or more support struts 23, is located between a bonding disk 21 and the cover 19, which is also used for bonding purposes. For reliably bonding the cover 19 via the support plate 18 to the bottom of the nozzle body 14, a bonding strut 24 may be provided between the supporting plate 18 and the cover 19. The operating voltage is supplied to the glow body 22 via the bonding disk 21 joined with it, the bonding disk 21 being joined via a wire strap 25 and a bonding pin 26 to a supply lead 27. The bonding pin 26 here is part of an electrical duct 28, soldered in place in a temperature-proof and pressure-tight manner, in the housing 17. The housing 17 has openings 29 through which the wire strap 25 is guided to the bonding disk 21, and also through which an air flow from the combustion chamber can reach the bottom of the nozzle body 14, specifically at precisely the point where the fuel spray 20 originates between the nozzle body 14 and the valve needle 15.

The mode of operation of the exemplary embodiment shown is as follows:

Once the fuel injection nozzle is opened for the duration of one injection charge, then the fuel spray aspirates air, operating on the principle of a jet pump; the air envelops it and travels past the cylindrical glow body such that the glow body does not touch the fuel but instead heats up the air envelope, which then in turn heats up the fuel. However, not only is the air envelope heated up as it travels past glow body, but the infrared radiation of the heating element also acts upon the fuel droplets in the injected fuel spray and heats them. Because the nozzle bottom is flushed with fresh air, the nozzle cannot accumulate or become stopped up with soot particles, and the fuel spray quality remains unchanged, in terms of quantity and droplet size, over long periods of operation.

Figure 2:
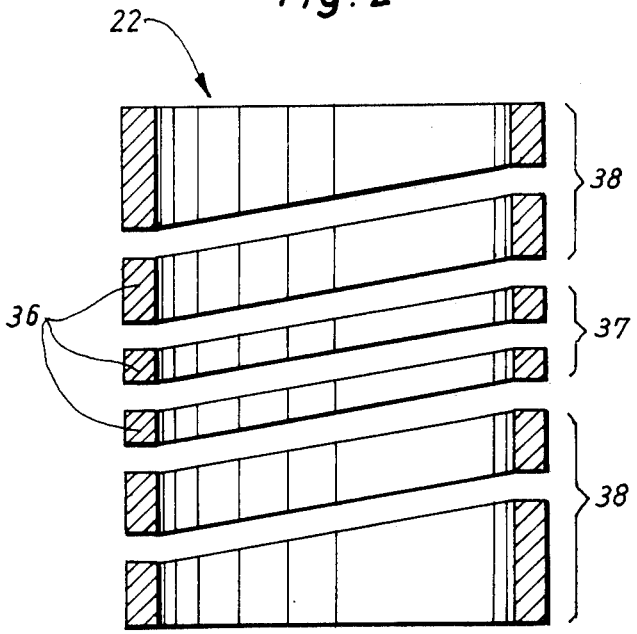
FIG. 2 shows a helical heating resistor which is embodied as a cylindrical glow body.

FIG. 2 shows a cylindrical glow body, embodied as a helical heating resistor, without bonding disks. The cylindrical glow body 22 comprises a helical heating resistor 36, the cross section of which is smaller in a middle region 37 of the glow body 22 than in its outer regions 38; hence the resistance is also higher in the middle region 37 than in the outer regions 38. As a result, the middle region 37 acts as a high-temperature region, because its resistance with respect to the length of the heating resistor is greater than in the outer regions 38. The outer regions 38 become a low-temperature region; its lesser electrical resistance causes lesser heating by electric current, so that durable bonding and securing is attainable here.

Figure 3:
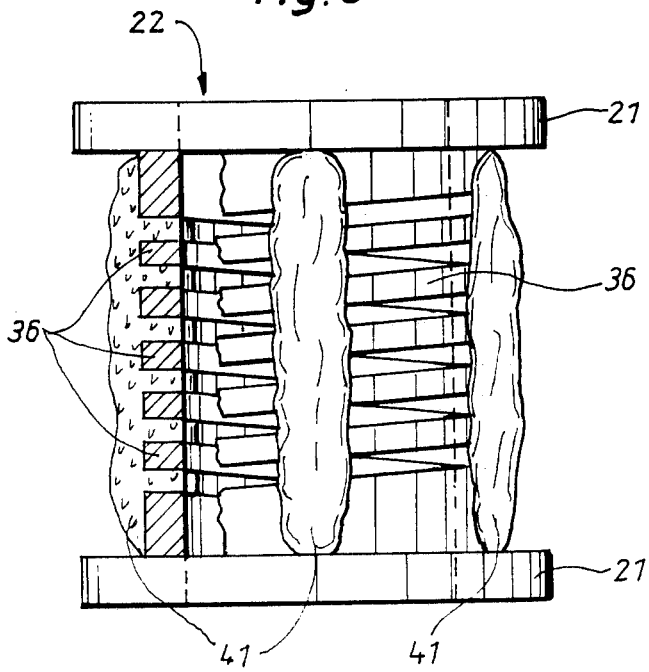
FIG. 3 shows a helical heating resistor having bonding discs.

In FIG. 3, the helical heating resistor 36, which is secured between two bonding disks 21, is mechanically secured between its coils with axially attached layers 41 of ceramic paste provided at predetermined spaced intervals.

Figure 4:
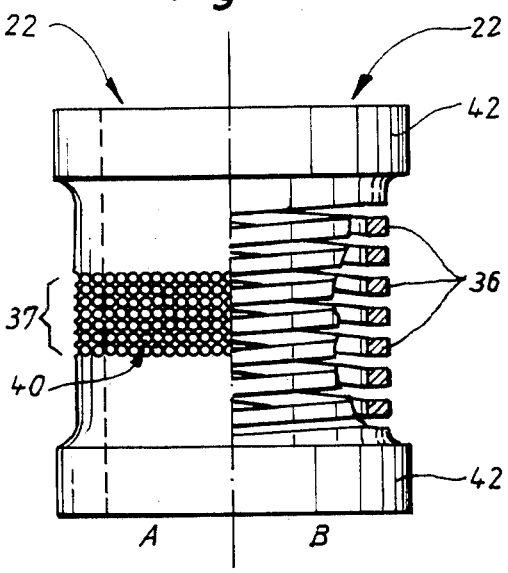
FIG. 4 shows two embodiments of the glow body.

The exemplary embodiment of a cylindrical glow body 22 is shown in two variants A and B in FIG. 4. Both variants have end collars 42 for the purpose of retention and bonding. In variant A, the middle region 37 acting as the high-temperature region is embodied by a cell-like perforation 40, which reduces the cross section of the resistance material and thus causes an increase in resistance. In variant B of FIG. 4, the helical heating resistor 36 is shown, which because of its uniform pitch has the same cross section over the entire coiled region. The desired temperature drop in the bonding region is effected here by the sturdy end collars 42, by means of their lower electrical resistance. The coil 36 may be supported in the same manner as in FIG. 3.

Figure 5:
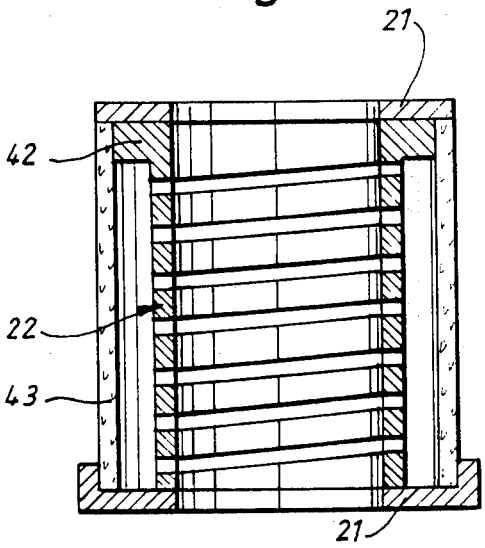
FIG. 5 shows an exemplary embodiment having a glow body which is surrounded by a ceramic protective tube.

The heating element shown in FIG. 5 shows the cylindrical glow body 22 inside a ceramic support tube 43. The glow body 22 has only one end collar 42 in this exemplary embodiment. As shown in the drawing, it is embodied as a helical resistor, which now no longer needs to be designed in accordance with criteria of mechanical strength, because the ceramic support tube 43 assumes the task of providing mechanical strength.

The glow body is located between the two bonding disks and is supplied therefrom with operating voltage.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A device for injecting fuel into combustion chamber of self-igniting internal combustion engines, comprising a fuel injection nozzle which generates a fuel spray in accordance with the operating cycle of the engine, an air guide device in proximity to said fuel injection nozzle and through which the fuel spray aspirates combustion air in the manner of a jet pump, said combustion air arranged to surround the fuel spray with an air envelope, a heating device having a length and spaced axially from said fuel injection nozzle said heating device further comprising a heating element having predetermined regions, the heat generation of said heating device being distributed over said length in such a manner that a different temperature prevails in an intermediate region from that in adjacent regions and further that said heating element is embodied as a resistance heating element through which electric current flows, the heating resistance of said element being higher in said intermediate region than in said adjacent regions.

2. A device for injecting fuel in combustion chambers as defined by claim 1, further wherein said resistance heating element comprises a cylindrical glow body having end faces, said end faces arranged to be electrically bonded to said glow body.

3. A device for injecting fuel in combustion chambers as defined by claim 2, further wherein said cylindrical glow body has a diameter, said diameter being increased toward said end faces.

4. A device for injecting fuel in combustion chambers as defined by claim 2, further wherein said end faces of said glow body are arranged to receive bonding disks.

5. A device for injecting fuel in combustion chambers as defined by claim 2, further wherein said cylindrical glow body is embodied, at least in said intermediate region as a helical heating resistor the coils of which have a smaller cross section in said region than in said adjacent regions.

6. A device for injecting fuel in combustion chambers as defined by claim 5, further wherein said helical heating resistor is milled out of a tube of resistance material having a predetermined pitch said pitch of said milled coils being variable in order to vary the cross section of the resistor coils.

7. A device for injecting fuel in combustion chambers as defined by claim 5, further wherein said helical heating resistor comprises $MoSi_2$.

8. A device for injecting fuel in combustion chambers as defined by claim 5, further wherein said helical heating resistor comprises windings, at least some of said windings being provided with strut means.

9. A device for injecting fuel in combustion chambers as defined by claim 8, further wherein said strut means comprise axially attached layers of insulating ceramic paste.

10. A device for injecting fuel in combustion chambers as defined by claim 8, further wherein said strut means further comprises an insulating cylinder which surrounds said helical heating resistor.

11. A device for injecting fuel in combustion chambers as defined by claim 2, further wherein said cylindrical glow body further includes a jacket face provided with means defining openings and further that said means defining said opening has a density in said intermediate region which is greater than in said adjacent regions.

12. A device for injecting fuel in combustion chambers as defined by claim 11, further wherein said means defining said openings is present only in said intermediate region of said cylindrical glow body.

13. A device for injecting fuel in combustion chambers as defined by claim 1, further wherein said resistance heating element comprises a cylindrical glow body which further includes at least partially in the form of a cellular structure.

* * * * *